US005213495A

United States Patent [19]

Pan

[11] Patent Number: 5,213,495

[45] Date of Patent: May 25, 1993

[54] SAFETY LIGHTER

[76] Inventor: Hsin-Chung Pan, c/o Hung Hsing Patent Service Center, P.O. Box 55-1670, Taipei (10477), Taiwan

[21] Appl. No.: 830,637

[22] Filed: Feb. 4, 1992

[51] Int. Cl.[5] ..... F23Q 1/02

[52] U.S. Cl. ..... 431/344; 431/153; 222/153

[58] Field of Search ..... 431/153, 277, 344; 222/402.11

[56] References Cited

U.S. PATENT DOCUMENTS 3,453,065 7/1969 Dupont ..... 431/153
3,898,031 8/1975 Rusakowicz ..... 431/153 X
4,403,945 9/1983 Leitgib ..... 431/146 X
4,717,335 1/1988 Loveless ..... 431/153 X
4,784,601 11/1988 Nitta ..... 431/153

*Primary Examiner*—Carl D. Price

[57] ABSTRACT

A safety lighter includes a lever adjustable pivotally mounted on a top formed frame above a cover sealed on an upper portion of a lighter container filled with liquid petroleum gas, the lever being slidably thrusted to be locked on a stopper extension formed on the top frame for preventing a depression of the lever for preventing any unexpected sparking and gas ignition operation of the lighter, thereby ensuring a fire protection safety in using the lighter.

2 Claims, 2 Drawing Sheets

SAFETY LIGHTER

BACKGROUND OF THE INVENTION

A conventional gas lighter, especially a disposable lighter, includes a plastic container filled with liquid petroleum gas, a lever, a striker wheel, a flint, a burner and a gas valve, whereby upon a depression of the lever to open the gas valve and rotate the striker wheel for sparking the flint, a gas stream from the burner will be ignited and burned for producing a lighter flame. However, it is very easy to depress the lever to ignite the lighter gas to cause an accident fire especially when "played" by an innocent child without being cared by his or her parents, possibly causing fire hazard such as burning injury or death to humanbeing or damage to properties.

It is therefore expected to disclose a safety lighter provided with a locking mechanism for preventing an unexpected striking of the lighter for ensuring a safety living.

SUMMARY OF THE INVENTION

The object of the present invention is to provide a safety lighter including a lever adjustably pivotally mounted on a top frame formed above a cover sealed on an upper portion of a lighter container filled with liquid petroleum gas, the lever being slidably thrusted to be locked on a stopper extension formed on the top frame for preventing a depression of the lever for preventing any unexpected sparking and gas ignition operation of the lighter, thereby ensuring a fire protection safety in using the lighter.

DETAILED DESCRIPTION

Figure 1:
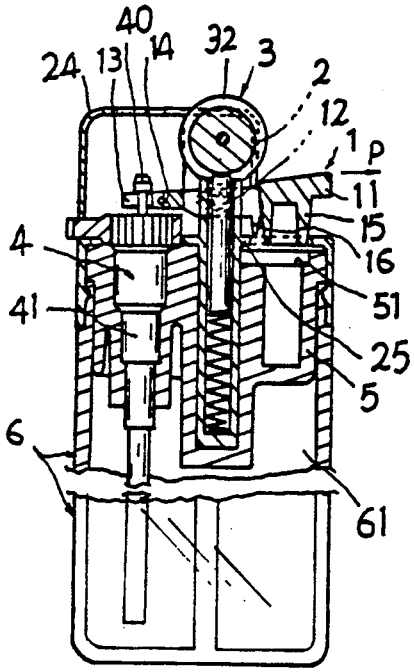
FIG. 1 is an illustration of the present invention for normal ignition purpose.

As shown in FIGS. 1–4, the present invention comprises: a lever 1, a top frame 2, an igniting means 3, a gas valve means 4, a cover 5, and a gas container 6 filled with liquid petroleum gas 61 or other fuels.

The lever 1 generally formed as a longitudinal plate includes: a depression plate portion 11 formed on a rear portion of the lever 1, a pair of pivots 12 transversely formed on a middle portion of the lever 1 pivotally mounted in a pair of pivot hole sets 21 formed in the top frame 2, a slit 13 formed in a front portion of the lever 11 defined in between two clamping members 131 for clamping a nozzle 40 of the gas valve means 4, a nozzle slot 14 formed in an inner portion of the slit 13 having a slot opening slightly larger than an outer periphery of the nozzle 40 for disengaging the clamping of the nozzle 40 from the lever 1, a guiding stem 15 protruding downwardly from the depression plate portion 11 to be reciprocatively held in a socket 51 recessed downwardly in the cover 5 sealed on an upper portion of the gas container 6, and a limiting stem 16 protruding downwardly from the depression plate portion 11 contiguous to the guiding stem 15.

The top frame 2 formed on the cover 5 above the gas container 6 includes: a pair of pivot hole sets 21 for pivotally mounting the pair of pivots 12 of the lever 1, a wind shield 24 disposed around a nozzle 40 of the gas valve means 4 above the cover 5 of the container 6, and a stopper extension 25 formed on a lower central portion of the top frame 2 adjacent to a socket 51 recessed in the cover 5 for operatively retarding a downward depression of the limiting stem 16 of the lever 1; each pivot hole set 21 generally dovetail shaped having a front pivot hole 22 and a rear pivot hole 23 for alternatively slidably engaging each pivot 12 of the lever 1.

The igniting means 3 is so conventional and including a flint 31 operatively sparked by a striker wheel 32 rotatably mounted on the top frame 2.

The gas valve means 4 being also a conventional one includes the nozzle 40 and a gas valve 41 which is opened when the nozzle 40 is clamped by the clamping members 131 of the lever and raised by the lever 1 upon a depression of the depression plate portion 11 of the lever 1.

Figure 2:
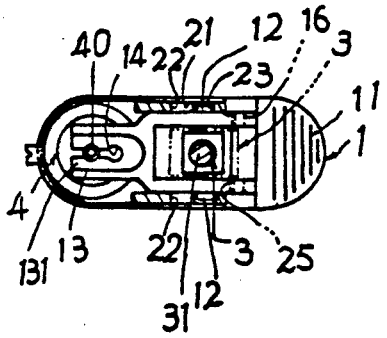
FIG. 2 is a top view illustration of FIG. 1.

As shown in FIGS. 1, 2, when it is intended to use the lighter of the present invention for igniting a flame, the lever 1 is pulled rearwardly in direction P to move each pivot 12 to be engaged with each rear pivot hole 23 and to move the limiting stem 16 under the depression plate portion 11 rearwardly to leave away (disengage) from the stopper extension 25 of the top frame 2. Then, the depresion plate portion 11 is downwardly depressed to bias the front clamping members 131 upwardly to raise the nozzle 40 and open the valve 41 and rotate the striker wheel 32 for sparking the flint 31 for igniting a gas stream flowing upwardly outwardly through the gas valve 41 for producing a flame for some burning purposes.

Figure 3:
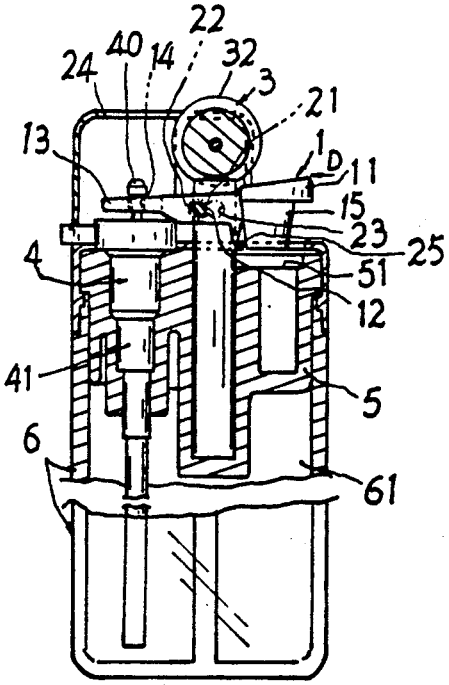
FIG. 3 is an illustration of the present invention when locked.
Figure 4:
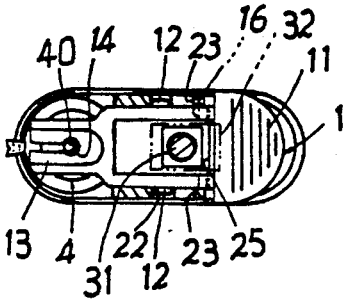
FIG. 4 is a top view illustration of FIG. 3.

When it is intended to lock the lighter of the present invention for safety purpose as shown in FIGS. 3, 4, the lever 1 is depressed frontwardly as shown in direction D of FIG. 3 to push the clamping members 131 frontwardly to engage the slot 14 with the nozzle 40 without clamping the nozzle 40 and also to push the limiting stem 16 frontwardly to be positioned above the stopper extension 25 of the frame 2. Upon an intentional depression on the depression plate portion 11 of the lever 1, the limiting stem 16 will be retarded by the stopper extension 25 without raising the gas nozzle 40 and without opening the gas valve 41 for preventing an unexpected ignition of the lighter. The slot 14 is larger than the nozzle 40 so that the front lever end portion will also not clamp and raise the nozzle 40 for doubly ensuring the lighter safety.

Therefore, the present invention provides a very safe lighter for preventing any unexpected ignition of the lighter especially preventing a playing and accidentally igniting of the lighter, thereby preventing an unexpected fire accident.

Figure 6:
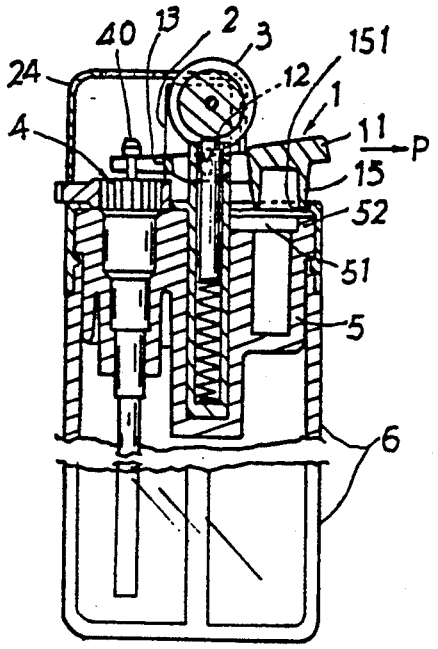
FIG. 6 shows a locked lighter of the present invention as shown in FIG. 5.
Figure 5:
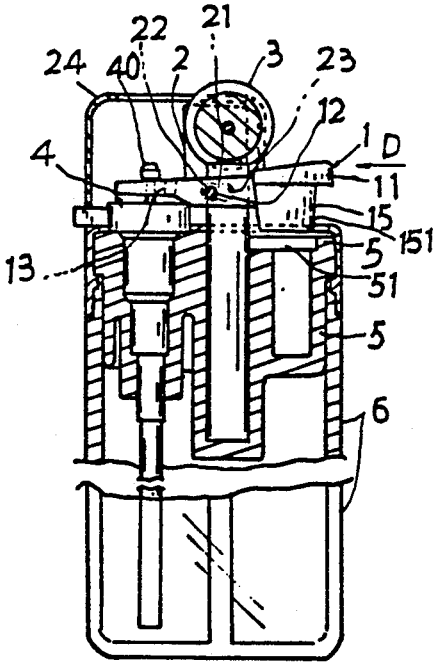
FIG. 5 shows another preferred embodiment of the present invention.

Another preferred embodiment of the present invention is shown in FIGS. 5, 6, in which the lighter is modified to include a stopper extension portion 52 on a rear upper portion of the socket 51 of the cover 5 covering the container 6 to operatively retard a downward depression of a rear limiting edge portion 151 formed on a bottom portion of the guiding stem 15 of the lever 1 when pulling the lever 1 rearwardly as shown in direction P as shown in FIG. 6. When depressing the lever 1, the rear limiting edge portion 151 of the guiding stem 15 of the lever 1 will be obstructed by the stopper extension portion 52 formed on the cover 5, thereby preventing an unexpected depression of the lever 1 for locking the ignition of the lighter for safety purpose.

For normal sparking and igniting use, the lever 1 is depressed frontwardly in direction D of FIG. 5 to push the pivots 12 frontwardly to respectively engage the front pivot holes 22 to allow the guiding stem 15 to be reciprocatively held in the socket 51 of the cover 5 for actuating the igniting means 3 and opening the gas valve means 4 for igniting the lighter flame.

I claim:

1. A safety lighter comprising:

a gas container filled with liquid petroleum gas in the container having a cover sealed on an upper portion of said container and a top frame secured above said cover of said gas container; and a lever pivotally and slidably mounted on said top frame for operatively opening a gas valve means formed in a front portion of said lighter upon a depression of said lever; said top frame including a pair of pivot hole sets, said lever including:

a guiding stem protruding downwardly from a depression plate portion formed on a rear portion of said lever, said guiding stem having a limiting edge portion formed on a bottom portion of said guiding stem to be operatively retarded by a stopper extension portion formed on an edge portion of a socket recessed in a rear upper portion of said cover on said gas container, said lever having a pair of pivots each said pivot alternatively slidably engageable with a front pivot hole or a rear pivot hole formed in each pivot hole set formed in said top frame, whereby upon a sliding movement of said lever to slidably engage each said pivot on said lever with one said pivot hole on said frame, said guiding stem of said lever is moved to be operatively retarded against said edge portion of said socket by said stopper extension portion formed in said socket of said cover for preventing the depression of the lever for locking the lighter gas valve means.

2. A safety lighter comprising:

a gas container filled with liquid petroleum gas in the container having a cover sealed on an upper portion of said container and a top frame secured above said cover of said gas container; and a lever pivotally and slidably mounted on said top frame for operatively opening a gas valve means formed in a front portion of said lighter upon a depression of said lever;

said lever generally formed as a longitudinal plate including: a depression plate portion formed on a rear portion of the lever, a pair of pivots transversely formed on a middle portion of the lever pivotally mounted in a pair of pivot hole sets formed in the top frame, a slit formed in a front portion of the lever defined in between two clamping members for clamping a nozzle of the gas valve means, a nozzle slot formed in an inner portion of the slit having a slot opening slightly larger than an outer periphery of the nozzle for disengaging the clamping of the nozzle from the lever, a guiding stem protruding downwardly from the depression plate portion to be reciprocatively held in a socket recessed downwardly in the cover sealed on an upper portion of the gas container, and a limiting stem protruding downwardly from the depression plate portion contiguous to the guiding stem; and said top frame formed on the cover above the gas container including: a pair of said pivot hole sets for pivotally mounting the pair of pivots of the lever, and a stopper extension formed on a lower central portion of the top frame adjacent to a socket recessed in the cover for operatively retarding a downward depression of the limiting stem of the lever thereby locking the lighter; each said pivot hole set generally dovetail shaped having a front pivot hole and a rear pivot hole for alternatively slidably engaging each said pivot of said lever.

* * * * *